US009101040B2

(12) United States Patent
Heid

(10) Patent No.: US 9,101,040 B2
(45) Date of Patent: Aug. 4, 2015

(54) DC VOLTAGE-OPERATED PARTICLE ACCELERATOR

(75) Inventor: Oliver Heid, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/824,543

(22) PCT Filed: May 20, 2011

(86) PCT No.: PCT/EP2011/058269

§ 371 (c)(1),
(2), (4) Date: Mar. 18, 2013

(87) PCT Pub. No.: WO2012/034718

PCT Pub. Date: Mar. 22, 2012

(65) Prior Publication Data

US 2013/0181599 A1 Jul. 18, 2013

(30) Foreign Application Priority Data

Sep. 16, 2010 (DE) ..... 10 2010 040 855

(51) Int. Cl.
*H05H 5/06* (2006.01)

(52) U.S. Cl.
CPC ..... *H05H 5/06* (2013.01)

(58) Field of Classification Search
CPC ..... H05H 5/066; H05H 5/06
USPC ..... 313/361.1, 359.1; 315/111.01–111.91
See application file for complete search history.

(56) References Cited

U.S. PATENT DOCUMENTS

| | | | | | |
|---|---|---|---|---|---|
| 2,887,599 | A | * | 5/1959 | Trump | 313/420 |
| 3,209,269 | A | | 9/1965 | Arthur et al. | 315/506 |
| 3,353,107 | A | | 11/1967 | Graaff | 315/506 |
| 3,866,132 | A | * | 2/1975 | Gorka, Jr. | 315/505 |
| 4,963,748 | A | * | 10/1990 | Szilagyi | 250/396 R |
| 5,821,705 | A | * | 10/1998 | Caporaso et al. | 315/507 |
| 2006/0011866 | A1 | | 1/2006 | Cho | 250/492.21 |

(Continued)

FOREIGN PATENT DOCUMENTS

| | | | | |
|---|---|---|---|---|
| DE | 1936102 B2 | 3/1971 | ..... | G21K 1/093 |
| DE | 102009023305 A1 | 12/2010 | ..... | A61N 5/10 |
| EP | 0412896 A1 | 2/1991 | ..... | H05H 5/00 |

(Continued)

OTHER PUBLICATIONS

Boscolo, Ilario et al., "A 1-MW, 1-mm Continuous-Wave FELtron for Toroidal Plasma Heating," IEEE Transactions on Plasma Science, vol. 20, No. 3, 8 pages, Jun. 1, 1992.

(Continued)

*Primary Examiner* — Nimeshkumar Patel
*Assistant Examiner* — Jacob R Stern
(74) *Attorney, Agent, or Firm* — Slayden Grubert Beard PLLC

(57) ABSTRACT

A DC voltage-operated particle accelerator for accelerating a charged particle from a source to a target includes a first electrode arrangement and a separate second electrode arrangement. The first electrode arrangement and the second electrode arrangement are disposed in such a way that the particle successively runs through the first electrode arrangement and the second electrode arrangement. Each of the electrode arrangements is designed as a high-voltage cascade.

11 Claims, 7 Drawing Sheets

(56) References Cited

U.S. PATENT DOCUMENTS

| | | | | |
|---|---|---|---|---|
| 2010/0033115 | A1 | 2/2010 | Cleland et al. | 315/501 |
| 2012/0068632 | A1 | 3/2012 | Heid | 315/500 |

FOREIGN PATENT DOCUMENTS

| | | | | |
|---|---|---|---|---|
| EP | 0471601 | A2 | 2/1992 | G01V 5/00 |
| JP | 2007123000 | A | 5/2007 | G21K 1/087 |
| WO | 2012/034718 | A1 | 3/2012 | H05H 5/06 |

OTHER PUBLICATIONS

Beasley, P. et al., "A New Life for High Voltage Electrostatic Accelerators," Proceedings of IPAC'10, Kyoto, Japan, 4 pages, May 23, 2010.

International Search Report and Written Opinion, Application No. PCT/EP2011/058269, 15 pages, Sep. 27, 2011.

* cited by examiner

DC VOLTAGE-OPERATED PARTICLE ACCELERATOR

CROSS-REFERENCE TO RELATED APPLICATIONS

This application is a U.S. National Stage Application of International Application No. PCT/EP2011/058269 filed May 20, 2011, which designates the United States of America, and claims priority to DE Patent Application No. 10 2010 040 855.7 filed Sep. 16, 2010 The contents of which are hereby incorporated by reference in their entirety.

TECHNICAL FIELD

The present disclosure relates to a DC voltage-operated particle accelerator for accelerating a charged particle from a source to a target.

BACKGROUND

Particle accelerators for accelerating charged particles by electric fields are known in the art. They are used for accelerating charged particles, for example elementary particles, atomic nuclei or ionized atoms, to high speeds and energies. Particle accelerators are used in fundamental research as well as in medicine and for various industrial purposes.

DC voltage-operated particle accelerators use a high DC electric voltage for accelerating the particles. The maximum usable acceleration voltage is in this case primarily limited by the electric field strength occurring and by the resulting insulation outlay. This insulation outlay increases more than cubically with the voltage to be insulated.

SUMMARY

One embodiment provides a DC voltage-operated particle accelerator for accelerating a charged particle from a source to a target, wherein the particle accelerator comprises a first electrode arrangement and a second electrode arrangement separated therefrom, wherein the first electrode arrangement and the second electrode arrangement are arranged in such a way that the particle travels through the first electrode arrangement and the second electrode arrangement in chronological succession, and wherein each of the electrode arrangements is formed as a high-voltage cascade.

In a further embodiment, each of the electrode arrangements comprises a multiplicity of concentrically arranged metal half-shells, the half-shells form capacitor plates of the high-voltage cascade, and a radially innermost half-shell of each electrode arrangement has a greater electrical potential difference with respect to a ground potential than the other half-shells of the same electrode arrangement.

In a further embodiment, a half-shell has an opening through which the particle can move.

In a further embodiment, the source is at a positive electrical potential, the source is formed in order to emit a positively charged particle, and the target is at a negative electrical potential.

In a further embodiment, the source is at a negative electrical potential, the source is formed in order to emit a negatively charged particle, and the target is at a positive electrical potential.

In a further embodiment, the source is formed in order to emit a negatively charged particle, the particle accelerator comprises a charge conversion device for converting a negatively charged particle into a positively charged particle, and the charge conversion device is at a positive electrical potential.

In a further embodiment, the source is at a negative electrical potential, and the target is at ground potential.

In a further embodiment, the source is at ground potential, and the target is at a negative electrical potential.

In a further embodiment, the source and the target are at a negative electrical potential.

In a further embodiment, the particle accelerator comprises a third electrode arrangement, and the source is located in the first electrode arrangement, the deflecting device is located in the second electrode arrangement, and the target is located in the third electrode arrangement.

In a further embodiment, the particle accelerator comprises a charge conversion device for deflecting the charged particle, the source and the target are arranged in the same electrode arrangement, and the deflecting device is at a positive electrical potential.

In a further embodiment, the deflecting device comprises a magnet.

BRIEF DESCRIPTION OF THE DRAWINGS

Example aspects and embodiments are explained in more detail below with reference to the figures, in which.

DETAILED DESCRIPTION

Figure 1:
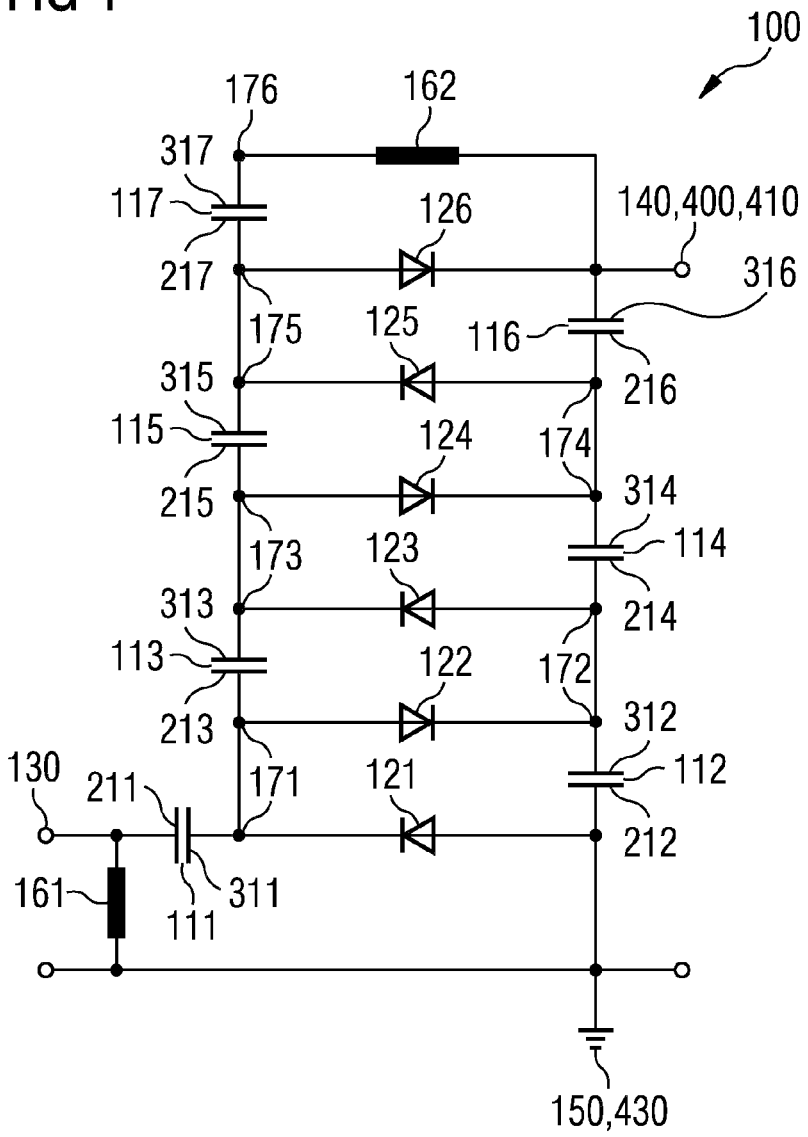
FIG. 1 shows a first high-voltage cascade in a schematic circuit arrangement.

Some embodiments provide an improved DC voltage-operated particle accelerator for accelerating a charged particle. For example, in some embodiments a DC voltage-operated particle accelerator for accelerating a charged particle from a source to a target comprises a first electrode arrangement and a second electrode arrangement separated therefrom. The first electrode arrangement and the second electrode arrangement are in this case arranged in such a way that the particle travels through the first electrode arrangement and the second electrode arrangement in chronological succession. Each of the electrode arrangements is in this case formed as a high-voltage cascade. Advantageously, in this DC voltage-operated particle accelerator, in contrast to a previously known DC voltage-operated particle accelerator, the particle to be accelerated only has to pass through half the acceleration voltage two times in order to obtain the same final energy. The insulation outlay for insulating the high voltages is thereby reduced significantly. The DC voltage-operated particle accelerator can therefore have a substantially smaller volume and be produced economically. Furthermore, the energy storage in the electrode arrangements is also reduced, so that the energy released in the event of possible arcing is minimized, which also limits the potential damage. Another possible advantage of the disclosed DC voltage-operated particle accelerator is that a high-voltage cascade with a lower number of stages is sufficient for generating the lower high voltages. The internal resistance of the high-voltage cascade is thereby reduced, which leads to a smaller voltage variation under load.

Each of the electrode arrangements may comprise a multiplicity of concentrically arranged metal half-shells, which form capacitor plates of the high-voltage cascade. In this case, a radially innermost half-shell of each electrode arrangement has a greater electrical potential difference with respect to a ground potential than the other half-shells of the same electrode arrangement. Advantageously, this permits a particularly compact design of the electrode arrangements.

It is expedient for a half-shell to have an opening through which the particle can move. Advantageously, the particle can then be accelerated out of the electrode arrangement or into the electrode arrangement.

In another embodiment of the particle accelerator, the source is at a positive electrical potential and is formed in order to emit a positively charged particle. The target is then at a negative electrical potential. Advantageously, this particle accelerator is suitable for accelerating positively charged particles.

In another embodiment of the particle accelerator, the source is at a negative electrical potential and is formed in order to emit a negatively charged particle. The target is in this case at a positive electrical potential. Advantageously, this particle accelerator is suitable for accelerating a negatively charged particle.

In a further embodiment of the particle accelerator, the source is formed in order to emit a negatively charged particle. In this case, the particle accelerator comprises a charge conversion device for converting a negatively charged particle into a positively charged particle. This charge conversion device is at a positive electrical potential. Advantageously, the particle accelerator can then be used as a tandem accelerator, so that at least one of the acceleration voltages can be used two times for accelerating the particle.

In one embodiment of this particle accelerator, the source is at a negative electrical potential, and the target is at ground potential. Advantageously, the target can be grounded in this particle accelerator, so that handling of the particle accelerator is simplified. Depending on the target used, grounding of the target may even be indispensable.

In another embodiment of this particle accelerator, the source is at ground potential and the target is at a negative electrical potential. Advantageously, the source can be grounded in this particle accelerator, which may be necessary depending on the source used, or at least simplifies handling of the particle accelerator.

In a further embodiment of the particle accelerator, the source and the target are each at a negative electrical potential. Advantageously, in this particle accelerator, the particle to be accelerated can travel through an even greater number of potential differences, so that the achievable final energy of the particle to be accelerated is increased.

In one embodiment of this particle accelerator, the particle accelerator comprises a third electrode arrangement. In this case, the source is located in the first electrode arrangement, the charge conversion device is located in the second electrode arrangement, and the target is located in the third electrode arrangement. Advantageously, the particle to be accelerated respectively travels through the potential differences of the first and third electrode arrangement once and in fact two times through the potential difference of the second electrode arrangement.

In another embodiment of this particle accelerator, the particle accelerator comprises a deflecting device for deflecting the charged particle, which device is at a positive electrical potential. The source and the target are in this case arranged in a common electrode arrangement. Advantageously, in this particle accelerator, the potential differences of both electrode arrangements are respectively traveled through two times.

FIG. 1 shows a circuit diagram of a first high-voltage cascade 100 known per se. The first high-voltage cascade 100 may also be referred to as a Greinacher cascade, a Villard cascade or a Siemens circuit. The first high-voltage cascade 100 is used for generating a high DC electric voltage from an AC electric voltage with a lower peak voltage.

The first high-voltage cascade 100 has a voltage input 130, to which an input AC voltage relative to a ground contact 150 can be applied. The input AC voltage may, for example, have a peak voltage of a few kV and a frequency of, for example, 100 Hz. A transformer, which generates the desired input AC voltage from a mains voltage with a lower peak value, may also be arranged at the voltage input 130.

The first high-voltage cascade 100 furthermore has a voltage output 140, at which the output DC voltage relative to the ground contact 150 is provided. The output DC voltage at the voltage output 140 is proportional to the peak value of the input AC voltage at the voltage input 130 and the number of stages of the first high-voltage cascade 100. The output DC voltage at the voltage output 140 may, for example, be a few tens of MV.

The first high-voltage cascade 100 has a multiplier line comprising a first node 171, a third node 173, a fifth node 175 and a sixth node 176. The first high-voltage cascade 100 furthermore has a smoothing line comprising a second node 172, a fourth node 174 and the voltage output 140.

A first diode 121 is arranged between the ground contact 150 and the first node 171, with the cathode of the first diode 121 facing toward the first node 171. A second diode 122 is arranged between the first node 171 and the second node 172, with the cathode of the second diode 122 facing toward the second node 172. A third diode 123 is arranged between the second node 172 and the third node 173, with the cathode of the third diode 123 facing toward the third node 173. A fourth diode 124 is arranged between the third node 173 and the fourth node 174, with the cathode of the fourth diode 124 facing toward the fourth node 174. A fifth diode 125 is arranged between the fourth node 174 and the fifth node 175, with the cathode of the fifth diode 125 facing toward the fifth node 175. A sixth diode 126 is arranged between the fifth node 175 and the voltage output 140, with the cathode of the sixth diode 126 facing toward the voltage output 140.

A first capacitor 111, comprising a first capacitor plate 211 and a second capacitor plate 311, is arranged between the voltage input 130 and the first node 171 in such a way that the first capacitor plate 211 is connected to the voltage input 130 and the second capacitor plate 311 is connected to the first node 171. A second capacitor 112, comprising a third capacitor plate 212 and a fourth capacitor plate 312, is arranged between the ground contact 150 and the second node 172, the third capacitor plate 212 being connected to the ground contact 150 and the fourth capacitor plate 312 being connected to the second node 172. A third capacitor 113, comprising a fifth capacitor plate 213 and a sixth capacitor plate 313, is arranged between the first node 171 and the third node 173, the fifth capacitor plate 213 being connected to the first node 171 and the sixth capacitor plate 313 being connected to the third node 173. A fourth capacitor 114, comprising a seventh capacitor plate 214 and an eighth capacitor plate 314, is arranged between the second node 172 and the fourth node 174, the seventh capacitor plate 214 being connected to the second node 172 and the eighth capacitor plate 314 being connected to the fourth node 174. A fifth capacitor 115, comprising a ninth capacitor plate 215 and a tenth capacitor plate 315, is arranged between the third node 173 and the fifth node 175, the ninth capacitor plate 215 being connected to the third node 173 and the tenth capacitor plate 315 being connected to the fifth node 175. A sixth capacitor 116, comprising an eleventh capacitor plate 216 and a twelfth capacitor plate 316, is arranged between the fourth node 174 and the voltage output 140, the eleventh capacitor plate 216 being connected to the fourth node 174 and the twelfth capacitor plate 316 being connected to the voltage output 140.

The first high-voltage cascade 100 of FIG. 1 has three stages. The first stage of the first high-voltage cascade 100 is formed by the first capacitor 111, the first diode 121, the second capacitor 112 and the second diode 122. The second stage of the first high-voltage cascade 100 is formed by the third capacitor 113, the third diode 123, the fourth capacitor 114 and the fourth diode 124. The third stage of the first high-voltage cascade 100 is formed by the fifth capacitor 115, the fifth diode 125, the sixth capacitor 116 and the sixth diode 126. In the three-stage first high-voltage cascade 100, the output voltage provided at the voltage output 140 corresponds approximately to six times the peak voltage of the AC voltage applied to the voltage input 130, reduced by a multiple of the threshold voltages of the diodes 121 to 126. The first high-voltage cascade 100 may be supplemented with additional stages by continuing the periodicity of the circuit. In a four-stage high-voltage cascade, the output voltage provided at the voltage output corresponds to eight times the peak voltage of the input voltage, reduced by the threshold voltages of the diodes. The first high-voltage cascade 100 could, for example, have 50 or 100 stages.

Possible stray capacitances between the capacitor plates of the various capacitors 111 to 116 lead to a reduction of the output voltage provided at the voltage output 140. In order to compensate for such stray capacitances, the first high-voltage cascade 100 has a first compensation coil 161, a second compensation coil 162 and a seventh capacitor 117. The first compensation coil 161 is arranged between the voltage input 130 and the ground contact 150. The seventh capacitor 117 has a thirteenth capacitor plate 217 connected to the fifth node 175, and a fourteenth capacitor plate 317 connected to the sixth node 176. The second compensation coil 162 is arranged between the sixth node 176 and the voltage output 140. In a simplified embodiment of the high-voltage cascade 100, the first compensation coil 161, the second compensation coil 162 and the seventh capacitor 117 may be omitted.

The ground contact 150 of the first high-voltage cascade 100 is at an electrical ground potential 430. The voltage output 140 is at an electrical maximum potential 400. In the exemplary embodiment of the first high-voltage cascade 100 illustrated in FIG. 1, the electrical maximum potential 400 is a positive potential 410. A positive voltage is therefore applied between the voltage output 140 and the ground contact 150. If the polarity of all diodes 121, 122, 123, 124, 125, 126 of the first high-voltage cascade 100 were reversed, a negative potential 420 would result at the voltage output 140.

It is possible to redesign and partially combine the capacitor plates 111 to 117. This is schematically illustrated in FIG. 2 using a second high-voltage cascade 110.

The second high-voltage cascade 110 has two assemblies of concentrically arranged semicircular or hemispherical metal shells. In a lower assembly, a radially innermost shell forms the fourteenth capacitor plate 317. The next shell radially outward simultaneously forms the thirteenth capacitor plate 217 and the tenth capacitor plate 315. The next shell radially outward simultaneously forms the ninth capacitor plate 215 and the sixth capacitor plate 313. The next shell radially outward simultaneously forms the fifth capacitor plate 213 and the second capacitor plate 311. The radially outermost shell of the lower assembly forms the first capacitor plate 211. The radially innermost shell of the upper assembly forms the twelfth capacitor plate 316. The next shell of the upper assembly radially outward simultaneously forms the eleventh capacitor plate 216 and the eighth capacitor plate 314. The next shell radially outward simultaneously forms the seventh capacitor plate 214 and the fourth capacitor plate 312. The radially outermost shell of the upper assembly forms the third capacitor plate 212. The capacitor plates are interconnected to one another via the diodes 121 to 126, in a similar way to the first high-voltage cascade 100 of FIG. 1.

In the second high-voltage cascade 110, the maximum potential 400 exists inside the radially innermost shell of the top assembly, this being a positive potential 410 owing to the poling of the diodes 121 to 126.

Figure 2:
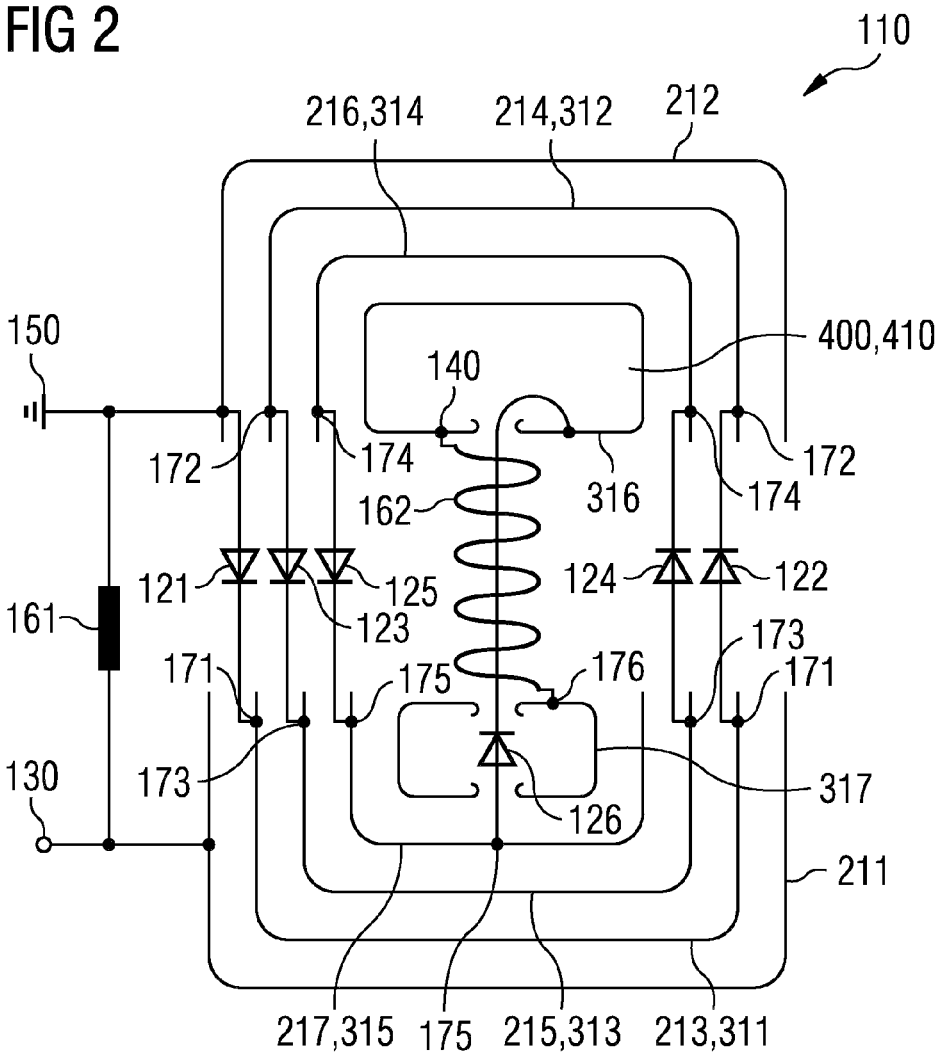
FIG. 2 shows a second high-voltage cascade, likewise in a schematized representation.
Figure 3:
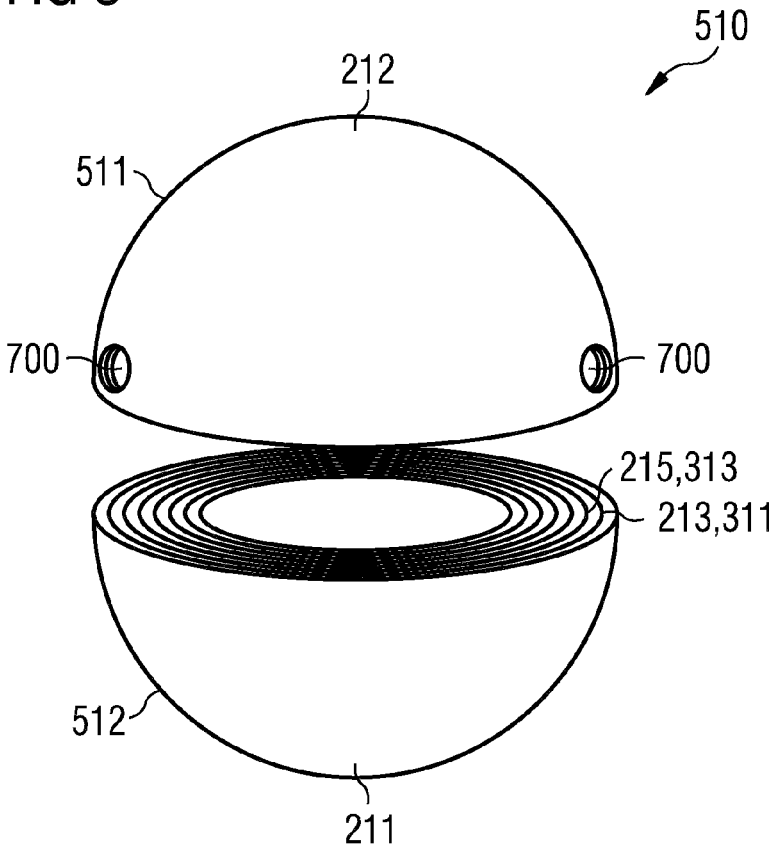
FIG. 3 shows a schematized first electrode arrangement.

FIG. 3 shows a schematized representation of a possible configuration of the capacitor plates of the second high-voltage cascade 110 of FIG. 2. For the sake of clarity, the diodes 121 to 126, the capacitors 111 to 117 and the coils 161, 162 are not represented here. FIG. 3 shows a first electrode arrangement 510, which comprises a first upper half-shell 511 and a first lower half-shell 512. The first upper half-shell 511 has a multiplicity of concentrically arranged hemispherical shells, which correspond to the upper capacitor plate assembly of FIG. 2. The radially outermost hemispherical shell therefore forms, for example, the third capacitor plate 212. The first lower half-shells 512 likewise comprise a multiplicity of concentrically arranged hemispherical shells, and correspond to the lower capacitor plate assembly of FIG. 2. The radially outermost of the first lower half-shells 512 forms the first capacitor plate 211. The next hemispherical shell of the first lower half-shells 512 radially inward forms the fifth capacitor plate 213 and the second capacitor plate 311. The next hemispherical shell radially inward forms the ninth capacitor plate 215 and the sixth capacitor plate 313.

The hemispherical shells of the first upper half-shells 511 and the hemispherical shells of the first lower half-shells 512 are respectively electrically insulated from one another.

The first upper half-shells 511 and the first lower half shells 512 may be arranged in a vacuum. The individual half-shells of each half-shell assembly 511, 512 are in this case spaced apart from one another and supported with respect to one another by means of electrically insulating support elements. The distance between individual hemispherical shells in the shell assemblies 511, 512 may, for example, be 1 cm.

The first upper half-shells 511 have two holes 700, which face one another and extend radially from the outside inward through all the hemispherical shells 511.

The first upper half-shells 511 and the first lower half-shells 512 need not necessarily be formed as hemispherical shells. For example, shells with an ellipsoid or cuboid shape are also possible. The first and second half-shells may, for example, also be formed in the shape of cups.

Figure 4:
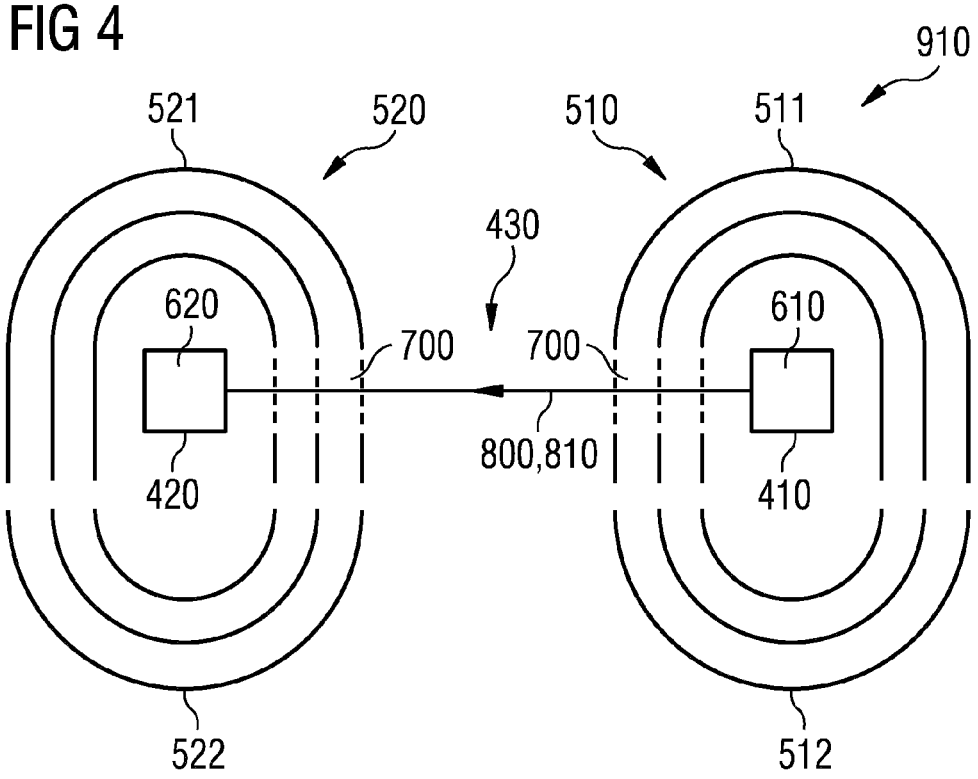
FIG. 4 shows a particle accelerator according to a first embodiment.

FIG. 4 shows a schematic view of a first particle accelerator 910. The first particle accelerator 910 is a DC voltage-operated particle accelerator and may be used to produce neutrons, to produce radioisotopes or for medical diagnostic and therapeutic purposes. The first particle accelerator 910 can accelerate charged particles to an energy of a few MeV.

The first particle accelerator 910 comprises the first electrode arrangement 510 of FIG. 3 and a second electrode arrangement 520, comprising second upper half-shells 521 and second lower half-shells 522. The first electrode arrangement 510 is formed in order to generate a positive electrical potential 410 inside it. The second electrode arrangement 520 is formed in order to generate a negative electrical potential 420 inside it. The second electrode arrangement 520 corresponds in its structure to the first electrode arrangement 510 of FIG. 3, although the diodes are poled in the reverse way.

The first particle accelerator 910 has a source 610, which is arranged inside the first upper half-shells 511 of the first electrode arrangement 510 at the positive electrical potential 410. Furthermore, the first particle accelerator 910 has a target 620, which is arranged at the negative electrical potential 420 inside the second upper half-shells 521 of the second electrode arrangement 520. The source 610 is formed in order to emit a particle beam 800 of positively charged particles 810. The positively charged particles 810 may, for example, be $H^+$ ions (protons). The positively charged particles 810 are accelerated through the hole 700 in the first electrode arrangement 510 by the potential difference between the positive potential 410 inside the first electrode arrangement 510 and the ground potential 430 prevailing outside the first electrode arrangement 510. The particle beam 800 is subsequently accelerated through the hole 700 in the second electrode arrangement 520, by the potential difference between the negative potential 420 inside the second electrode arrangement 520 and the ground potential 430 prevailing outside the second electrode arrangement 520, onto the target 620 in the second electrode arrangement 520. Overall, the positively charged particle beam 810 emitted by the source 610 thus travels through the potential difference between the positive potential 410 and the ground potential 430 and the potential difference between the ground potential 430 and the negative potential 420. If there is a voltage U1 between the positive potential 410 and the ground potential 430 and a voltage −U2 between the negative potential 420 and the ground potential 430, then each particle of the positively charged particle beam 810 is accelerated to an energy q(U1+U2), where q is the charge of the positively charged particle.

Figure 5:
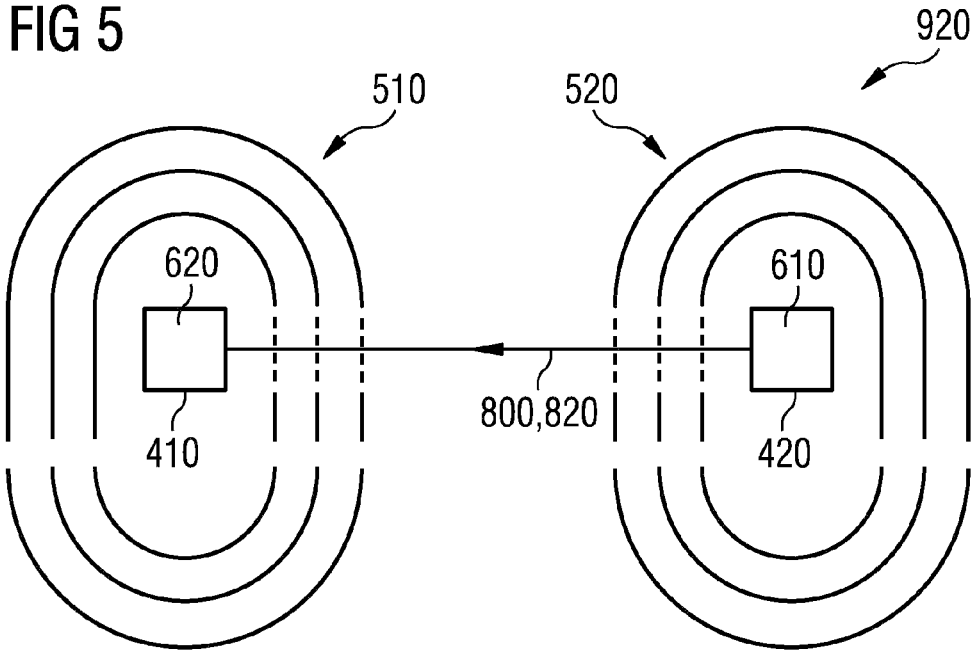
FIG. 5 shows a particle accelerator according to a second embodiment.

FIG. 5 shows a second particle accelerator 920. In contrast to the first particle accelerator 910, in the second particle accelerator 920 the source 610 is located in the second electrode arrangement 520 at the negative potential 420. In addition, the target 620 in the first electrode arrangement 510 is at the positive potential 410. Furthermore, the source 610 in the second particle accelerator 920 is formed in order to emit a particle beam 800 of negatively charged particles 820. The negatively charged particles 820 may, for example, be $H^-$ ions. The negatively charged particles 820 emitted by the source 610 are accelerated onto the target 620 first by the potential difference between the negative potential 420 and the ground potential 430 and subsequently by the potential difference between the ground potential 430 and the positive potential 410.

Figure 6:
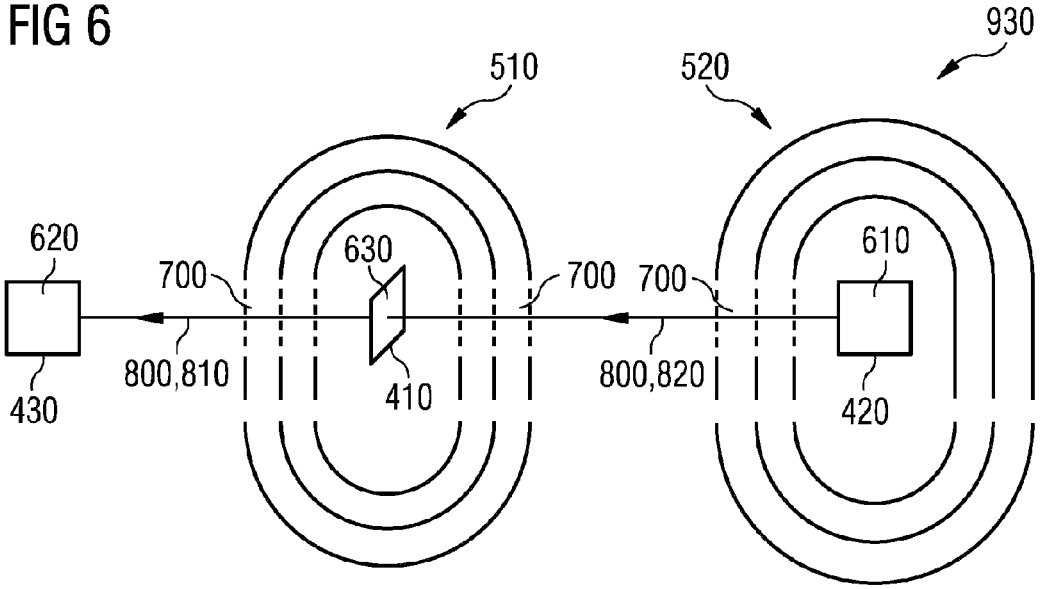
FIG. 6 shows a particle accelerator according to a third embodiment.

FIG. 6 shows a schematic representation of a third particle accelerator 930. The third particle accelerator 930 offers the advantage over the first particle accelerator 910 and the second particle accelerator 920 that the target 620 is at the ground potential 430. Furthermore, the third particle accelerator 930 can accelerate the particles of the particle beam 800 to a higher energy. The third particle accelerator 930 likewise has a first electrode arrangement 510 for generating the positive potential 410 and a second electrode arrangement 520 for generating the negative potential 420. The particle source 610 is located in the second electrode arrangement at the negative potential 420, and is formed in order to emit negatively charged particles 820.

In the first electrode arrangement 510, there is a charge conversion device 630. The charge conversion device 630 may also be referred to as a stripper, and may for example be formed as a foil. The charge conversion device 630 is formed in order to convert the negatively charged particles 820 of the particle beam 800 into positively charged particles 810. To this end, the charge conversion device 630 may, for example, strip electrons from the negatively charged particles 820 of the particle beam 800. If the negatively charged particles 820 are $H^-$ ions, then the charge conversion device 630 strips two electrons so that the negatively charged $H^-$ ions become positively charged $H^+$ ions.

The negatively charged particles 820 emitted by the source 610 are accelerated through the hole 700 of the second electrode arrangement by the potential difference between the negative potential 420 inside the second electrode arrangement 520 and the ground potential 430 prevailing outside the second electrode arrangement 520. The negatively charged particles 820 are subsequently accelerated through the hole 700 in the first electrode arrangement 510 toward the charge conversion device 630 by the potential difference between the positive potential 410 inside the first electrode arrangement 510 and the ground potential 430 prevailing outside the first electrode arrangement 510. In the charge conversion device 630, the negatively charged particles 820 are converted into positively charged particles 810. The positively charged particles 810 are subsequently accelerated again by the potential difference between the positive potential 410 inside the first electrode arrangement 510 and the ground potential 430 outside the first electrode arrangement 510, through the second hole 700 in the first electrode arrangement 510 toward the target 620. Overall, the particles of the particle beam 800 thus travel once through the potential difference between the negative potential 420 and the ground potential 430 and two times through the potential difference between the positive potential 410 and the ground potential 430.

Figure 7:
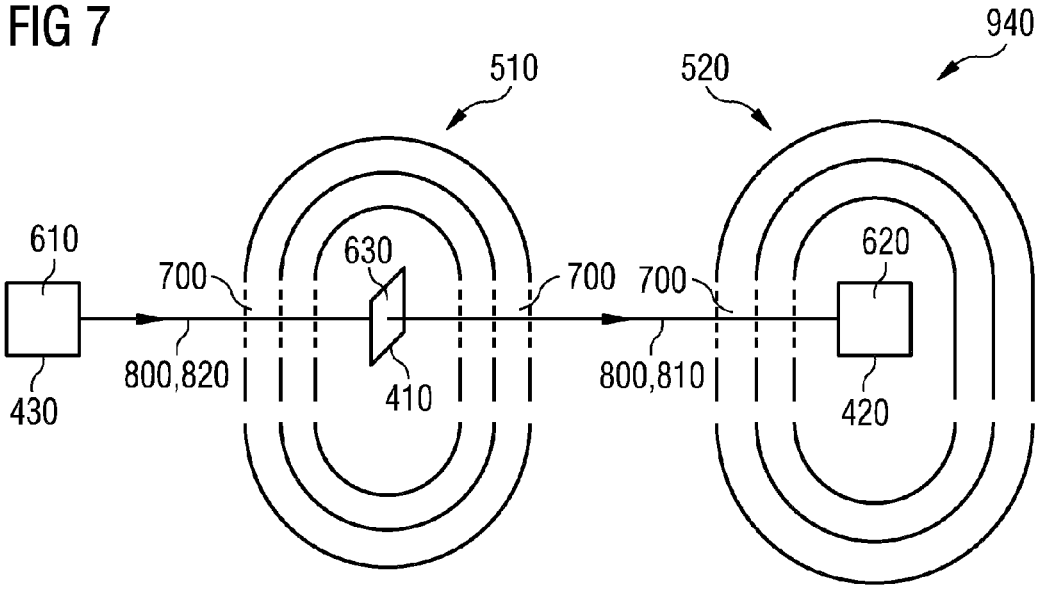
FIG. 7 shows a particle accelerator according to a fourth embodiment.

FIG. 7 shows a fourth particle accelerator 940. Compared with the third particle accelerator 930 of FIG. 6, in the fourth particle accelerator 940 of FIG. 7 the positions of the source 610 and the target 620 are interchanged. The source 610 is therefore located outside the first electrode arrangement 510 and the second electrode arrangement 520 is at ground potential 430. The target 620 is located inside the second electrode arrangement 520 at negative potential 420. The source 610 is formed in order to emit a particle beam 800 of negatively charged particles 820. The negatively charged particles 820 are initially accelerated by the potential difference between the positive potential 410 inside the first electrode arrangement 510 and the ground potential 430 at the location of the source 610, toward the charge conversion device 630 inside the first electrode arrangement 510. There, the positively charged particles 820 are converted into negatively charged particles 810. The negatively charged particles 810 are subsequently accelerated again by the potential difference between the positive potential 410 inside the first electrode arrangement 510 and the ground potential 430 outside the first electrode arrangement 510. Subsequently, the positively charged particles 810 are accelerated toward the target 620 inside the second electrode arrangement 520 by the potential difference between the negative potential 420 inside the second electrode arrangement 520 and the ground potential 430 prevailing outside the second electrode arrangement 520. In the fourth particle accelerator 940 as well, the particles of the particle beam 800 therefore travel through the potential difference between the positive potential 410 and the ground potential 430 two times and the potential difference between the negative potential 420 and the ground potential 430 once. In contrast to the third particle accelerator 930, however, in the fourth particle accelerator 940 the particle source 610 is at ground potential while the target 620 is at negative potential 420.

Figure 8:
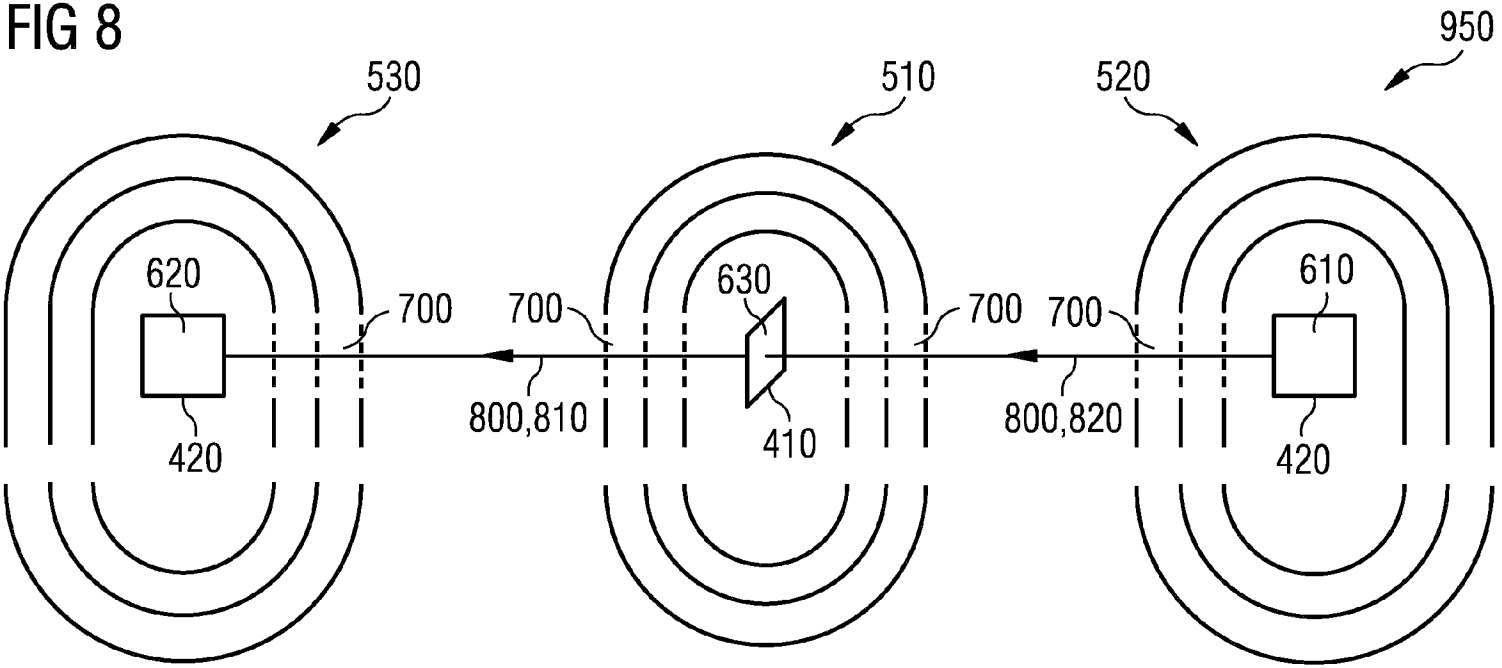
FIG. 8 shows a particle accelerator according to a fifth embodiment.

FIG. 8 shows a fifth particle accelerator 950 in a schematic representation. The fifth particle accelerator 950 again comprises a first electrode arrangement 510 for generating a positive potential 410 and a second electrode arrangement 520 for generating a negative electrical potential 420. The fifth particle accelerator 950 furthermore comprises a third electrode arrangement 530 for generating a negative potential 420, which need not correspond to the negative potential 420 of the second electrode arrangement 520. The third electrode arrangement 530 corresponds in its structure to the second electrode arrangement 520, and has third upper half-shells 531 and third lower half-shells 532. The third upper half-shells 531 in turn have a hole 700.

The fifth particle accelerator 950 has a source 610, which is formed in order to emit negatively charged particles 820 and which is arranged at the negative potential 420 inside the second electrode arrangement 520. The fifth particle accelerator 950 furthermore has a charge conversion device 630, which is arranged at the positive potential 410 inside the first electrode arrangement 510. In addition, the fifth particle accelerator 950 has a target 620 which is arranged at the negative potential 420 in the third electrode arrangement 530. A negatively charged particle 820 emitted by the source 610 is first accelerated by the potential difference between the negative potential 420 inside the second electrode arrangement 520 and the ground potential 430 outside the second electrode arrangement 520. Subsequently, the negatively charged particle 820 is further accelerated toward the charge conversion device 630 by the potential difference between the ground potential 430 and the positive potential 410 prevailing inside the first electrode arrangement 510. In the charge conversion device 630, the negatively charged particles 820 are converted into positively charged particles 810. The positively charged particles 810 are subsequently accelerated further by the potential difference between the positive potential 810 inside the first electrode arrangement 510 and the ground potential 430 prevailing outside the first electrode arrangement 510. Subsequently, the positively charged particles 810 are furthermore accelerated through the hole 700 in the third upper half-shells 531 of the third electrode arrangement 530 by the potential difference between the negative potential 420 inside the third electrode arrangement 530 and the ground potential prevailing outside the third electrode arrangement 530, toward the target 620 inside the third electrode arrangement. The particles of the particle beam 800 therefore travel overall two times through the potential difference between the positive potential 410 and the ground potential 430, once through the potential difference between the negative potential 420 inside the second electrode arrangement 520 and the ground potential 430, and once through the potential difference between the negative potential 420 inside the third electrode arrangement 530 and the ground potential 430.

Figure 9:
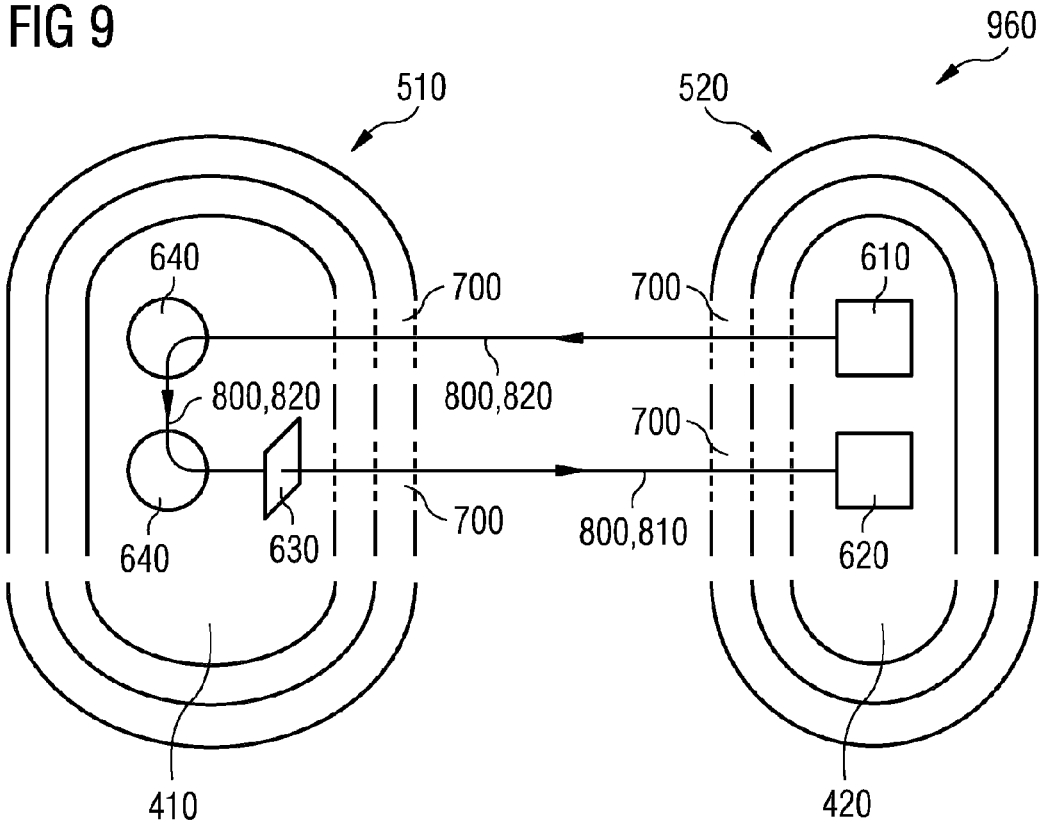
FIG. 9 shows a particle accelerator according to a sixth embodiment.

FIG. 9 shows a schematic representation of a sixth particle accelerator 960 according to a further embodiment. The sixth particle accelerator 960 in turn has a first electrode arrangement 510 for generating a positive potential 410 and a second electrode arrangement 520 for generating a negative potential 420. The sixth particle accelerator 960 furthermore has a source 610 for emitting negatively charged particles 820 and a target 620. The source 610 and the target 620 are arranged together inside the second electrode arrangement 520 at the negative potential 420. The second electrode arrangement 520 has two holes 700 in the embodiment of FIG. 9.

The sixth particle accelerator 960 furthermore has a deflecting device 640, which is formed in order to deflect the particle beam 800 of negatively charged particles 820 through 180°. To this end, the deflecting device 640 may, for example, comprise two deflecting magnets. The deflecting device 640 is arranged inside the first electrode arrangement 510 and is at the positive electrical potential 410.

The sixth particle accelerator 960 furthermore has a charge conversion device 630 for converting the negatively charged particles 820 into positively charged particles 810. The charge conversion device 630 is likewise arranged inside the first electrode arrangement 510 and is likewise at the positive electrical potential 410. In the direction in which the particle beam 800 travels, the charge conversion device 630 is arranged after the deflecting device 640. The charge conversion device 630 could, however, be arranged before the deflecting device 640 in the direction in which the particle beam 800 travels. In this case, the deflecting device 640 would need to be formed in order to deflect positively charged particles 810. In the embodiment of the sixth particle accelerator 960, the first electrode arrangement 510 likewise has two holes 700.

The source 610 emits the particle beam 800 of negatively charged particles 820. These are initially accelerated through the first hole 700 of the second electrode arrangement 520 by the potential difference between the negative potential 420 inside the second electrode arrangement 520 and the ground potential 430 prevailing outside the second electrode arrangement 520. Subsequently, the negatively charged particles 820 are accelerated through the first opening 700 of the first electrode arrangement 510 by the potential gradient between the positive potential 410 inside the first electrode arrangement 510 and the ground potential 430 prevailing outside the first electrode arrangement 510, toward the deflecting device 640. The deflecting device 640 deflects the particle beam 800 of negatively charged particles 820 inside the first electrode arrangement 510 through 180°. The particle beam 800 subsequently travels through the charge conversion device 630, where the negatively charged particles 820 are converted into positively charged particles 810. The positively charged particles 810 are subsequently accelerated further by the potential difference between the positive potential 410 inside the first electrode arrangement 510 and the ground potential 430 prevailing outside the first electrode arrangement 510, and leave the first electrode arrangement 510 through the second hole 700 of the first electrode arrangement 510. Subsequently, the positively charged particles 810 are accelerated further by the potential difference between the negative potential 420 inside the second electrode arrangement 520 and the ground potential 430 prevailing outside the second electrode arrangement 520, and thereby move through the second hole 700 of the second electrode arrangement 520 toward the target 620. Overall, the particles of the particle beam 800 thus travel two times through the potential difference between the negative potential 420 and the ground potential 430 and two times through the potential difference between the positive potential 410 and the ground potential 430. Since the sixth particle accelerator 960 has only two electrode arrangements 510, 520, it can be configured extremely compactly.

What is claimed is:

1. A DC voltage-operated particle accelerator for accelerating a charged particle from a source to a target, comprising:

a first electrode arrangement, and a second electrode arrangement separated from the first electrode arrangement, wherein the first electrode arrangement and the second electrode arrangement are arranged such that the particle travels through the first electrode arrangement and the second electrode arrangement in chronological succession, wherein each of the first and second electrode arrangements is formed as a high-voltage cascade, wherein each of the first and second electrode arrangements comprises multiple concentrically arranged metal half-shells that define capacitor plates of the high-voltage cascade, wherein a radially innermost half-shell of each electrode arrangement has a greater electrical potential difference with respect to a ground potential than each other half-shells of that electrode arrangement, and wherein the first electrode arrangement is configured to have a first potential generated inside it and the second electrode arrangement is configured to have a second opposite potential generated inside it.

2. The particle accelerator of claim 1, wherein each half-shell of each electrode arrangement has an opening through which the particle can move.

3. The particle accelerator of claim 1, wherein:

the source is at a positive electrical potential, the source is formed to emit a positively charged particle, and the target is at a negative electrical potential.

4. The particle accelerator of claim 1, wherein:

the source is at a negative electrical potential, the source is formed to emit a negatively charged particle, and the target is at a positive electrical potential.

5. The particle accelerator of claim 1, wherein:

the source is formed to emit a negatively charged particle, the particle accelerator comprises a charge conversion device for converting a negatively charged particle into a positively charged particle, and the charge conversion device is at a positive electrical potential.

6. The particle accelerator as claimed in claim 5, wherein:

the source is at a negative electrical potential, and the target is at ground potential.

7. The particle accelerator of claim 5, wherein:

the source is at ground potential, and the target is at a negative electrical potential.

8. The particle accelerator of claim 5, wherein the source and the target are at a negative electrical potential.

9. The particle accelerator of claim 8, wherein:

the particle accelerator comprises a third electrode arrangement, and the source is located in the first electrode arrangement, a deflecting device is located in the second electrode arrangement, and the target is located in the third electrode arrangement.

10. The particle accelerator of claim 8, wherein:

the particle accelerator comprises a charge conversion device for deflecting the charged particle, the source and the target are arranged in the same electrode arrangement, and the charge conversion device is at a positive electrical potential.

11. The particle accelerator of claim 10, wherein the charge conversion device comprises a magnet.

* * * * *